US007389779B2

(12) United States Patent
Chan

(10) Patent No.: US 7,389,779 B2
(45) Date of Patent: Jun. 24, 2008

(54) COMBING DEVICE WITH ADJUSTABLE TEETH SPACING

(75) Inventor: Wing Kin Chan, Kowloon (CN)

(73) Assignee: Dickson Industrial Co., Ltd., Hong Kong SAR (CN)

( * ) Notice: Subject to any disclaimer, the term of this patent is extended or adjusted under 35 U.S.C. 154(b) by 529 days.

(21) Appl. No.: 10/631,892

(22) Filed: Aug. 1, 2003

(65) Prior Publication Data

US 2004/0045569 A1 Mar. 11, 2004

(30) Foreign Application Priority Data

Sep. 6, 2002 (HK) ..... 02106602
Jan. 11, 2003 (HK) ..... 03100284

(51) Int. Cl.
*A45D 24/04* (2006.01)

(52) U.S. Cl. ..... 132/136; 132/137

(58) Field of Classification Search ..... 132/271, 132/136, 219, 137, 148, 138
See application file for complete search history.

(56) References Cited

U.S. PATENT DOCUMENTS 2,463,893 A * 3/1949 Marini ..... 132/136
2,535,612 A * 12/1950 Treloar et al. ..... 132/136
2,626,618 A * 1/1953 Collison ..... 132/136
3,464,427 A * 9/1969 Anton ..... 132/136
3,603,324 A * 9/1971 Cutrone ..... 132/136
3,939,850 A 2/1976 Wahl
4,475,563 A 10/1984 Martin
4,505,283 A * 3/1985 Pischdotchian ..... 132/213.1
5,400,809 A * 3/1995 Adams ..... 132/118
5,488,783 A * 2/1996 Parkinson et al. ..... 34/98
5,553,632 A * 9/1996 Burkhardt ..... 132/271
5,729,907 A 3/1998 Santhouse et al.
5,881,739 A * 3/1999 Walker et al. ..... 132/224
6,308,717 B1 10/2001 Vrtaric
2004/0250831 A1 * 12/2004 Rizzuto ..... 132/271

FOREIGN PATENT DOCUMENTS

DE 19522006 A1 1/1996
GB 2 365 335 2/2002
WO 84/00319 2/1984
WO 92/10958 7/1992

* cited by examiner

*Primary Examiner*—Robyn Doan
(74) *Attorney, Agent, or Firm*—Buchanan Ingersoll & Rooney PC

(57) ABSTRACT

A hair care device includes a hair comb with a plurality of combing teeth. The effective teeth spacing between adjacent combing teeth is adjustable. At least some of the combing teeth are thermally conductive so that heat can be conducted from the hair comb to a user's hair via the thermally conductive combing teeth when hair is being engaged under tension by the combing teeth.

21 Claims, 13 Drawing Sheets

SECTION B-B

SECTION C-C

SECTION D-D

SECTION C-C

SECTION A-A

SECTION B-B

SECTION A-A

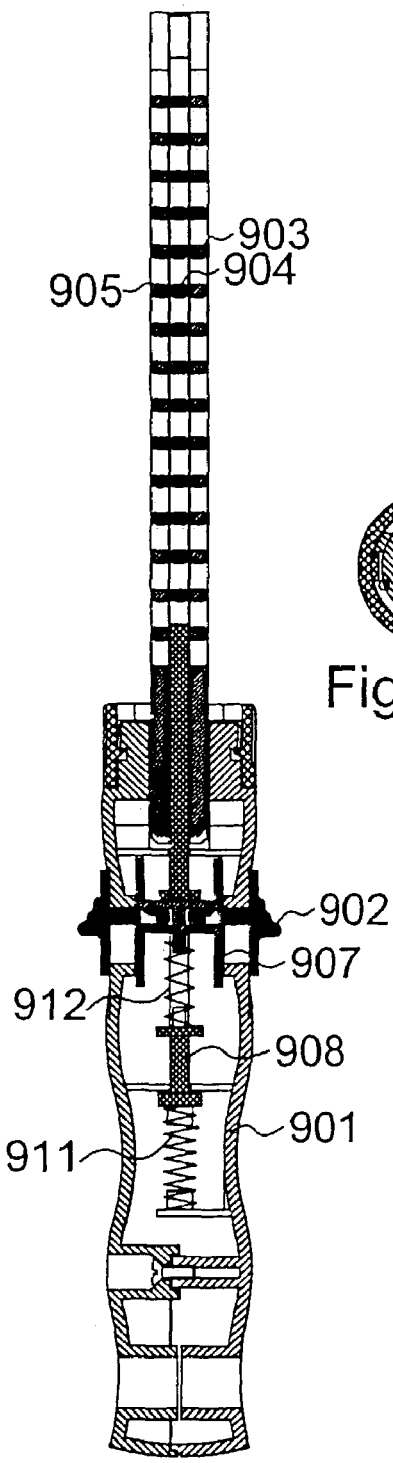
Fig. 22A
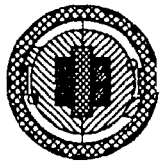
Fig. 22D
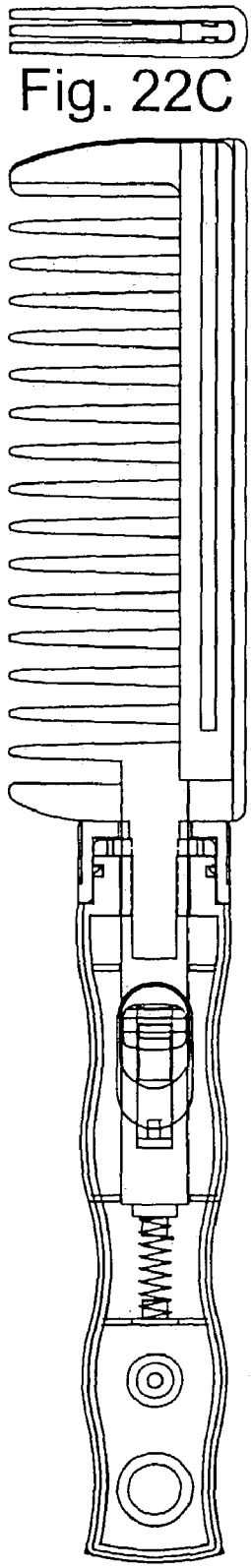
Fig. 22C
Fig. 22B

COMBING DEVICE WITH ADJUSTABLE TEETH SPACING

FIELD OF INVENTION

This invention relates generally to hair care means such as hair care devices, attachments and apparatus and, more particularly, to hair care devices, attachments and apparatus with means for combing hair, including combs and hairbrushes. More specifically, although of course not limited thereto, this invention relates to hair care devices with means for adjusting tension on the hair and heating means to heat or warm the hair under tension. This invention also relates to a hair care apparatus with an air blower and a combing attachment with an adjustable spacing between the teeth which can be coupled as an attachment to a hair care apparatus with air blower.

BACKGROUND OF THE INVENTION

Hair care devices with means for imparting tension to hair are known and widely used for general hair care such as combing and styling or for smoothing and tidying hair which has become messy. These types of hair care apparatus are also used to perform hair treatments as well as removing dirt and disentangling greasy and lumpy hair.

U.S. Pat. No. 5,729,907 describes such a hair care device as an attachment for a hair dryer with a comb and a heat transmissive plate for simultaneously drying and straightening of one's hair.

U.S. Pat. No. 3,939,850 describes a combined hair comb and dryer device having baffles arranged to focus the warm hair moving through the device towards the hair as the hair is moving through the comb.

United Kingdom Publication No. GB 2,365,335 describes a hair care apparatus with a combined hair dryer and comb for drying and straightening hair.

Hair care apparatus and devices having means for combing or imparting tension to hair, such as the ones described above, usually include a plurality of elongated teeth which are distributed along its length and overhanging an elongated base of the main housing of the devices or apparatus. In use, the elongated teeth engage with hair and are intermediate of the scalp and the handle portion of the apparatus or devices. Known hair care devices, attachments and apparatus with such combing or tension imparting characteristics usually suffer from the common shortcoming that the teeth spacing is not always suitable which means that different devices, attachments or apparatus must be selected for different persons in order to achieve optimal styling, caring or treatment to hair of different thickness or characteristics. Hence, it will be highly desirable if there can be provided devices, attachments or apparatus with such features which alleviate shortcomings of such conventional means or devices. Such devices or apparatus should be relatively simple and easy to use without requiring complicated or careful adjustment steps.

OBJECT OF THE INVENTION

It is therefore an object of the present invention to provide improved hair care devices, attachments and apparatus having combing or tension imparting means which alleviate shortcomings of known means and devices. It is also an object of this invention to provide an attachment for hair care apparatus or a hair care device or apparatus with combing means having adjustable teeth spacing suitable for use in hair blowing, straightening or styling. Of course, the above objectives are to be read disjunctively with the minimum of providing the public with a useful choice.

SUMMARY OF THE INVENTION

According to a first aspect of the present invention, there is provided a hair care device including hair combing means and means for adjusting effective teeth spacing between adjacent combing teeth, said hair combing means including a plurality of combing teeth, characterised in that at least some of said combing teeth being thermally conductive so that heat can be conducted from said combing means to said hair via said thermally conductive combing teeth when said hair is being engaged under tension by said combing teeth.

Preferably, the engaging tension on said hair being adjustable by varying the effective teeth spacing between said adjacent combing teeth.

In a preferred embodiment, said hair combing means including a first comb row and a second comb row each having a plurality of comb teeth, said first and said second comb rows being relatively movable so that the effective teeth spacing transversely across said combing means being variable by relative movement of said first and said second comb rows, wherein, at least some of said comb teeth being thermally conductive so that, when hair is engaged under tension by said comb assembly, heat can be transmitted to said hair via said thermally conductive comb teeth.

In a preferred embodiment, at least some of the comb teeth on said first and second comb rows being adapted so that the effective teeth spacing transversely across said combing means being adjustably by relative movements between said comb rows.

Preferably, the width of said some of said comb teeth being comparable to their teeth spacing.

Preferably, the width of said some of said comb teeth being comparable to the teeth spacing between correspondingly adjacent comb teeth.

In a preferred embodiment, said hair care device including heating means, wherein said heating means being disposed so that heat generated by said heating means can be transferred from said heating means to the hair via said combing means.

Preferably, said combing means including first combing means and second combing means which are relatively movable.

In a preferred embodiment, said hair care device including a main housing, wherein said first combing means being movable relative to said main housing, said first combing means includes a first comb row, said second combing means includes second and third combs, said first, second and third comb rows being generally parallel and said first comb row being intermediate of said second and third rows, wherein the effective combing teeth spacing of said combing means transverse to said comb rows being adjustable by relative movements of said first, second and third comb rows.

Preferably, said second and third combing rows being generally thermally conductive.

Preferably, said second combing means including metallic combing teeth extending from a metallic base.

In a preferred embodiment, each of said first, second and third comb rows including a plurality of generally parallel combing teeth, wherein the teeth of said comb rows being adapted so that the effective teeth spacing across said combing means being adjustably by relative movements of said comb rows.

In a preferred embodiment, including a handle, said first and second combing means being respectively movable and stationary relative to said handle, the width of the teeth on said first combing means being comparable to the teeth spacing between corresponding adjacent teeth or teeth pairs on said second combing means so that the effective spacing across said combing means being adjustable by movement of said first combing means.

Preferably, at least some of the teeth on said second combing means are thermally conductive so that when hair is engaged by said comb assembly, heat can be transmitted to said hair via said thermally conductive teeth.

In a preferred embodiment, said hair care device including a handle, wherein relative movements between said first and said second combing means being actuatable by an actuation button which is pivotable about a hinge, the movable combing means being urged away from said handle while said button is being depressed.

Preferably, said actuation button being under spring urge to return said movable combing means towards said handle when the actuation button is released.

Preferably, said first and second combing means being relatively translatable along a first orientation, said combing teeth being generally elongated and extending along a second orientation, wherein relative translation between said first and second combing means along said first direction will cause said elongated teeth on one combing means to traverse the spacing between adjacent teeth pairs on the other combing means to vary the effective teeth spacing of said device, said means for adjusting said effective teeth spacing controls the relative translation between said first and second combing means.

Preferably, said means for adjusting said effective teeth spacing includes a rotatable wheel.

In a preferred embodiment, a complete revolution of said rotatable wheel about its axis of rotation will move a combing tooth to a position previously occupied by an adjacent tooth.

Preferably, said rotatable wheel being connected to a turning knob, said turning knob including a screw-threaded shaft, the longitudinal axis of said shaft being parallel to said first direction.

Preferably, said first and said second directions being substantially orthogonal.

Preferably, said means for adjusting said effective teeth spacing including means to gradually translate one of said combing means.

Preferably, said gradual translation of said one of said combing means being driven by a screw-threaded rotary shaft, the longitudinal axis of said screw-threaded shaft being parallel to said first direction.

Preferably, said teeth spacing adjusting means further include means to maintain said one of said combing means at pre-determined positions along said first direction.

Preferably, said pre-determined positions correspond to discrete settings of the effective teeth spacing of said device.

Preferably, the teeth spacings on said first and second combing means being generally equal.

Preferably, said main housing include a hollow member with an air-inlet, an air-outlet, and a neck portion interconnecting said air-inlet and said air-outlet, said comb members being disposed at said air-outlet with said teeth pointing away from said air-outlet.

Preferably, said main housing includes means for coupling to the nozzle of a hair care apparatus with a blower.

Preferably, said device being a hair brush or hair brush attachment wherein said teeth are formed from bristles and said second direction along which said bristles extend being radial from the longitudinal axis of said brush.

According to another aspect of the present invention, there is provided a hair care device comprising:

a main housing;

at least a first comb mounted on said housing;

at least one second comb mounted on said housing on a generally parallel axis to said first comb and movable with respect to said first comb along said parallel axis such that teeth on said second comb may move intermediate of said teeth on said first comb to reduce the teeth spacing in a transverse direction;

actuating means to actuate movement of said second comb; and a pressure limiting mechanism to inhibit further movement of said second comb once a threshold pressure against further movement be reached caused by hair intermediate of the teeth of said first and second combs.

Preferably, said second comb member is biased by a first biasing means towards a position in which teeth of said first and second combs are substantially in line with each other in said transverse direction.

Preferably, said actuating mechanism overcomes said first biasing means to actuate movement of said second comb.

Preferably, said pressure limiting mechanism comprises a second biasing means acting on or within said actuating mechanism to allow further movement of said actuating mechanism without further movement of said second comb once a threshold of said second biasing means has been reached.

Preferably, said actuating mechanism includes button actuatable by a user and an indirect connection between said button and said second comb whereby said indirect connection includes said second biasing means.

BRIEF DESCRIPTION OF THE DRAWINGS

Preferred embodiments of the present invention will be explained in further detail by way of example and with reference to the accompanying drawings, in which

FIG. 22A is a front cross-sectional elevation of a yet further embodiment of the apparatus, FIG. 22B is a side cross-sectional elevation of the apparatus of FIG. 22A, FIG. 22C is an end elevation of the apparatus of FIG. 22B, and FIG. 22D is a cross-sectional end elevation of the apparatus of FIG. 22A.

DETAILED DESCRIPTION OF THE PREFERRED EMBODIMENTS

Figure 1:
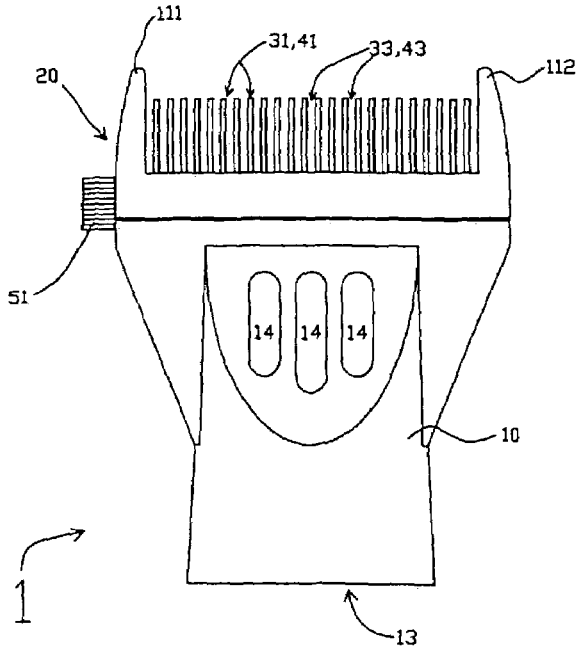
FIG. 1 is a top plan view of a comb attachment embodying a first preferred embodiment of the present invention with the teeth of the first and second combing members overlapping.
Figure 2:
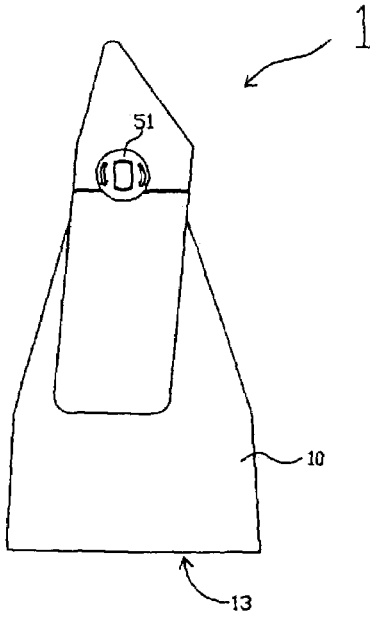
FIG. 2 is a side view of the attachment of FIG. 1 viewing from the left side.
Figure 3:
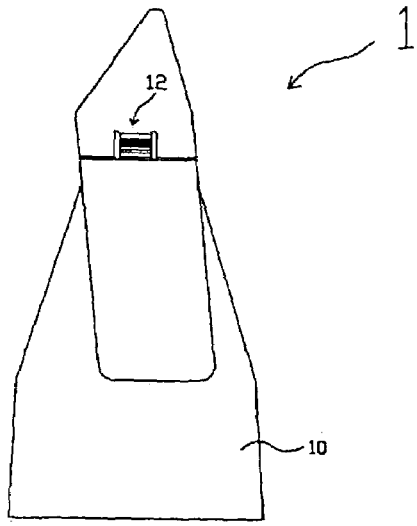
FIG. 3 is a side view of the attachment of FIG. 1 viewing from the right side.

Referring to FIGS. 1 to 7A, there is shown a first preferred embodiment of a hair care device of the present invention which is configured as a combing attachment. This combing attachment can be used with, for example, a hair-dryer or a hair blower. The combing attachment 1 includes hair combing means and means for adjusting the effective teeth spacing of the hair combing means. The hair combing means is mounted on a main housing 10 and includes a comb sub-assembly 20. The comb sub-assembly includes a first comb row or first comb member 30, a second comb row or second comb member 40. The means for adjusting the effective teeth spacing includes teeth width adjustment means 50. Each of the first comb member 30 and the second comb member 40 includes a plurality of elongated teeth 31, 41 which extend from an elongated base portion 32, 42. The directions of extension of the teeth and the base portion are generally substantially orthogonal.

Elongated teeth 31, 41 on the same comb member are generally parallel to each other and the separation between adjacent elongated teeth defines the teeth spacing. This teeth spacing defines the pitch of the corresponding comb member. In this example, the teeth spacings or the pitch 33, 43 between adjacent elongated teeth on the same comb member are substantially identical.

In addition, the width of the teeth and the teeth spacing on the same comb member are generally identical so that the combing teeth are substantially regularly distributed along the length of the base portion of the respective comb members. Throughout this specification, the width of the teeth spacing generally means the spread of the combing teeth along the length of the comb members or the combing means where appropriate. Also, the term effective teeth spacing generally means effective combing teeth spacing transverse to the length of the comb members.

The elongated teeth 31, 41 are substantially rigid or semi-rigid and are made of materials such as, for example, plastics, metal, bakelite, bone or the like. Of course, the elongated teeth can also be made of a flexible material such as soft plastics to form tufts or bristles. Where the elongated teeth are made of plastics or metal, the elongated teeth and the corresponding base portion can be integrally made by moulding or by stamping or pressing if from metal. For enhanced styling efficiency, the teeth 31, 41 are made of metal or other heat conductive materials.

As a variation, the elongated teeth can also be formed by tufts of bristles which are mounted on the base portion of the comb members as holders of the bristles. The first 30 and the second 40 comb members are mounted on the front portion of the main housing 10 so that the comb members 30, 40 are relatively movable in order to change, vary or adjust the effective teeth spacing of the comb attachment. This will assist to provide, for example, optimal teeth spacing for hair of corresponding specific thickness.

Since the hair being combed will have to pass through the effective teeth spacing of the comb attachment 1, in order to perform appropriate combing, the optimal teeth spacing should be adjustable so that it is neither too wide to allow too many hair to pass through a single pitch at the same time nor too narrow which makes the comb too difficult to move through the hair. As hair will be engaged by the effective teeth spacing, a certain degree of tension can be exerted on the hair as the combing member moves along the hair. Appropriate adjustment of the effective spacing will put the engaged hair under suitable tension when the comb moves along the hair.

In order to adjust the effective teeth spacing or pitch, the first 30 and the second 40 comb members are disposed in a relatively translatable configuration so that the elongated teeth of one comb member (the "first comb member") can be moved towards and away from the teeth member of the other comb member (the "second comb member"). This will result in a range of effective teeth spacing by co-operating between adjacent teeth of the first and the second comb members.

Figure 7:
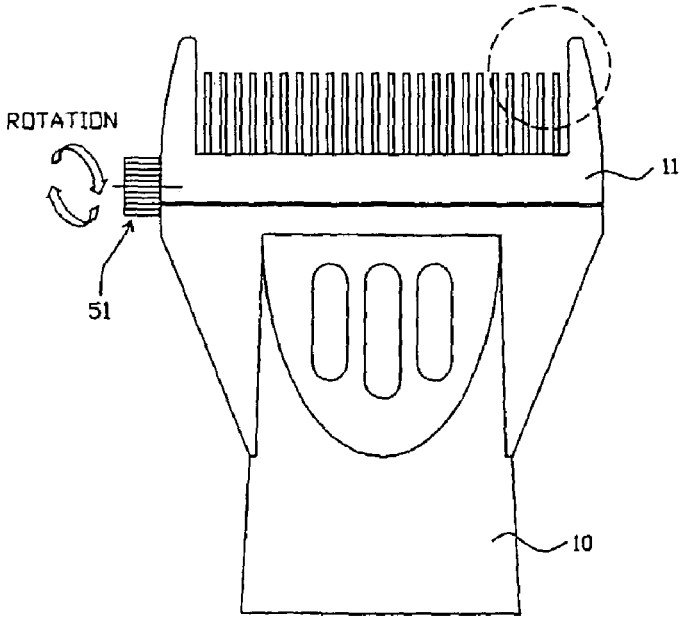
FIG. 7 illustrates the operation of the adjustment knob to vary the teeth spacing of the attachment of FIG. 1.
Figure 7A:
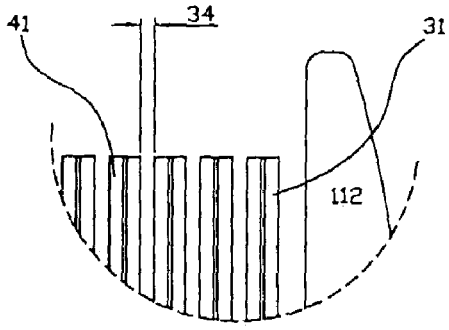
FIG. 7A is an enlarged view showing the circled portion of FIG. 7.
Figure 8:
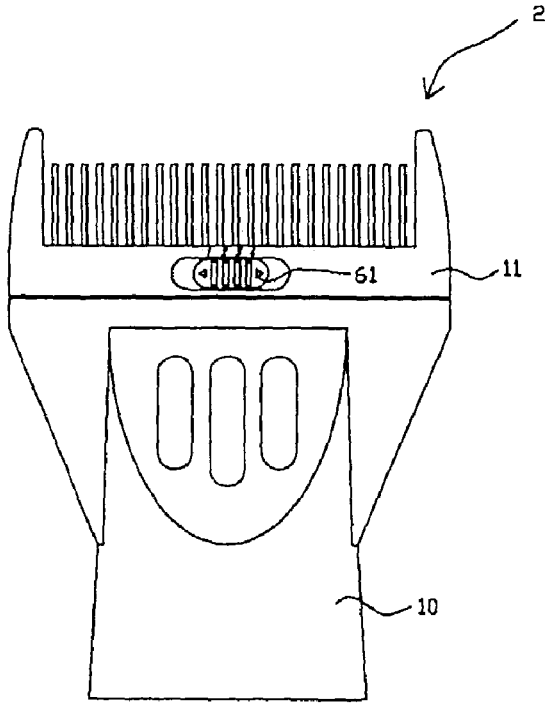
FIG. 8 is a top plan view of a comb attachment embodying a second preferred embodiment of the present invention.
Figure 9A:
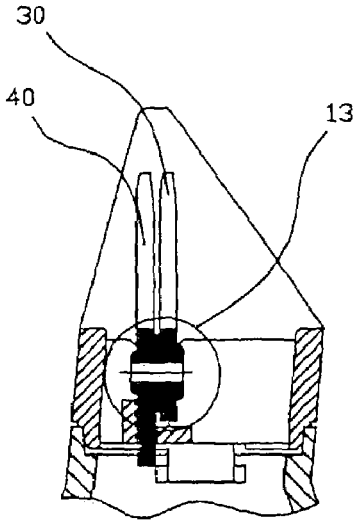
FIG. 9A is partial cross-section of the attachment of FIG. 8 taken along the line C-C.
Figure 9:
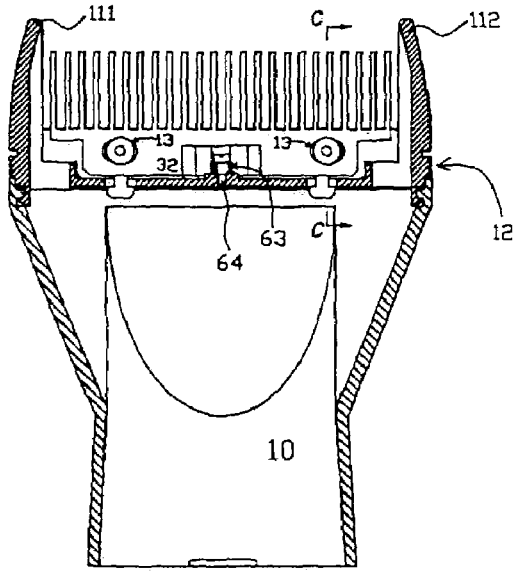
FIG. 9 is a cross-sectional view of the comb attachment of FIG. 8 taken along the line A-A.
Figure 9B:
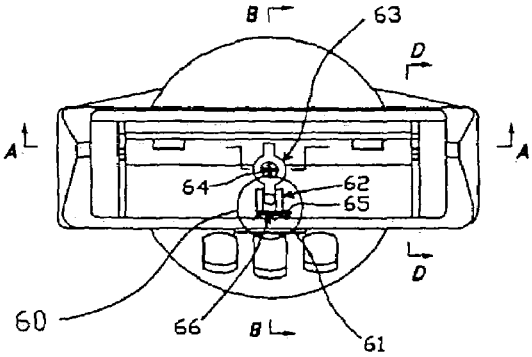
FIG. 9B is a front view of the attachment of FIG. 8 with the comb sub-assembly removed.
Figure 9C:
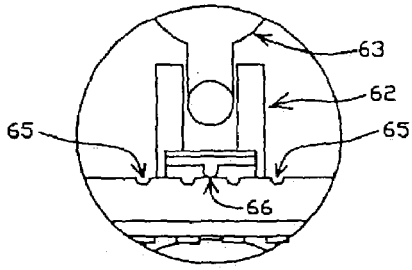
FIG. 9C is an enlarged view of the circled portion showing in more detail the engagement means being connected with the lower portion of the pivotal cock.
Figure 10A:
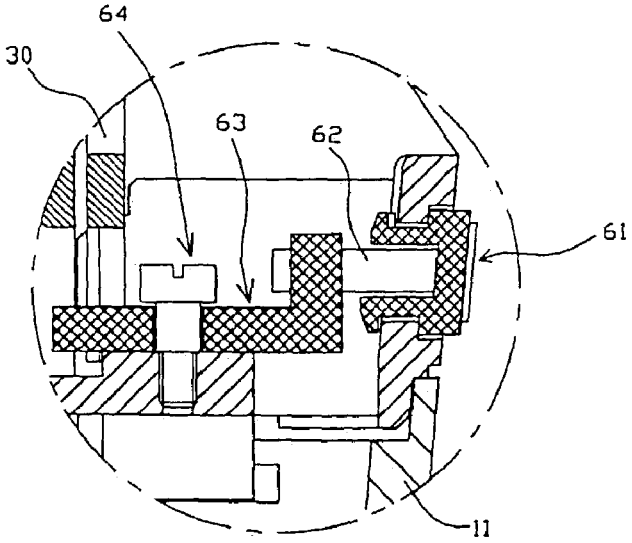
FIG. 10 is a cross-sectional view of the attachment of FIG. 8 along the line B-B and FIG. 10A is an enlarged view of the circled portion.
Figure 10:
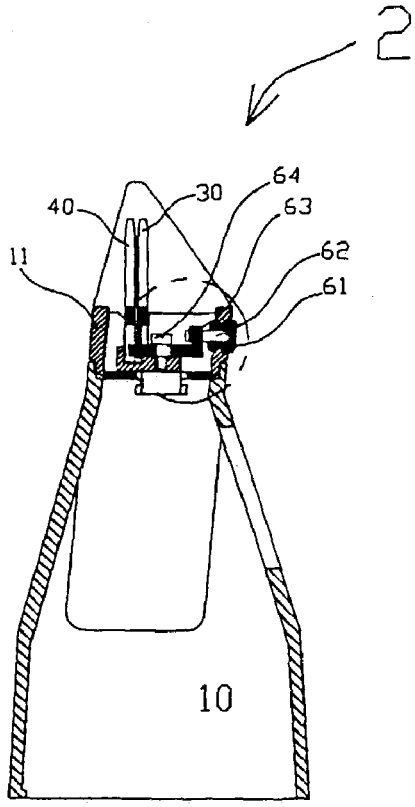
Figure 11:
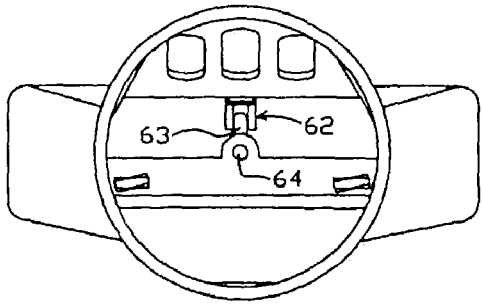
FIG. 11 is a rear view of the comb attachment of FIG. 8 revealing in more detail the pivotal cock for moving the engagement tab.

As a result of the relative movements between the first comb member 30 and the second comb member 40, part of the teeth spacing on the first, movable, comb member 30 is in turn covered by the elongated teeth on the second, fixed, comb member 40, therefore changing the overall effective teeth spacing 34 of the comb attachment, as illustrated in FIG. 7A.

For the avoidance of doubt, it will be understood that throughout this description, the effective teeth spacing means the spacing between adjacent elongated teeth minus the spacing being covered or traversed by the teeth on another comb member.

Since the teeth pitches as defined by adjacent teeth on the same comb member are generally parallel to each other, it is preferred that the adjusted teeth spacings are also generally parallel to each other and also generally parallel to the elongated teeth of the comb members. As such, the comb members are relatively movable along a first direction so that the elongated teeth on the moving comb member will remain parallel to that of the other (stationery) comb member during the relative movements, although the comb members are disposed at a different level.

In general, the first direction above is parallel to the length of the elongated comb member and is at an angle or inclination to the orientation or lengthwise axis of the elongated teeth. The elongated teeth extend generally along a second direction so that the effective teeth spacing 34 can be conveniently adjusted. In the present preferred embodiments, the comb members are arranged so that the orientation of the elongated teeth is generally orthogonal to the direction of relative movements or translation between the comb members. Thus, the first and the second directions in this embodiment are generally orthogonal and the effective teeth spacing is adjusted by relative movements of the comb members transversal to the second direction. Of course, the first and second direction can be non-orthogonal and can incline at an appropriate angle.

To provide further convenience, the adjustable comb sub-assembly is mounted on a head portion 11 which is detachable from the main housing 10. As can be seen from FIG. 3, a latching means 12 is provided on the head portion 11 to facilitate detachability between the comb sub-assembly and the main housing.

Turning more particularly to FIGS. 4 to 7A, the teeth spacing adjustment means and its operation will be explained in further details.

Figure 4:
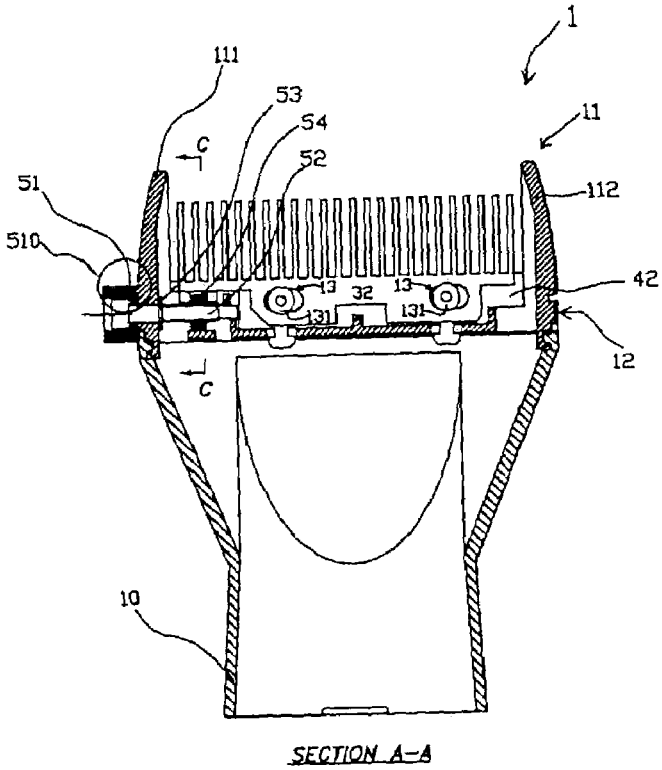
FIG. 4 is a cross-sectional view of the attachment of FIG. 1 taken along the sectional line A-A.
Figure 4A:
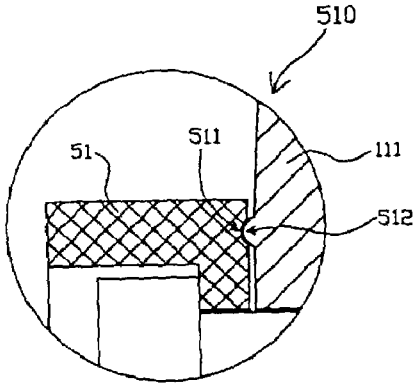
FIG. 4A is an enlarged view of the circled portion of FIG. 4.
Figure 4B:
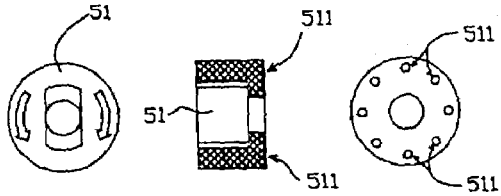
FIG. 4B is an enlarged view showing the cross-section, upper (left) and under (left) of the adjustment knob.
Figure 5:
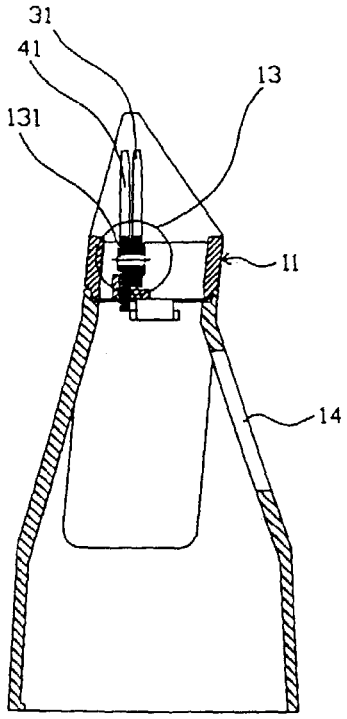
FIG. 5 is a cross-sectional view of the hair attachment of FIG. 1 taken along the sectional line B-B.
Figure 5A:
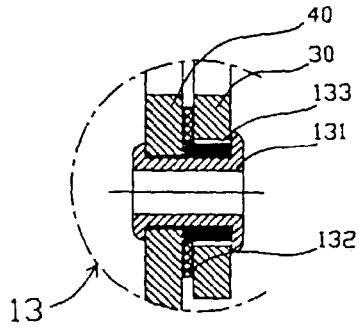
FIG. 5A is an enlarged view of the circled portion of FIG. 5.
Figure 5B:
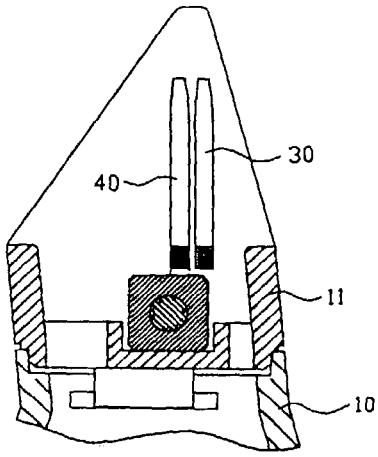
FIGS. 5B and 5C are partial cross-sectional views of the hair attachment of FIG. 1 taken respectively along the line C-C and D-D of FIG. 4.
Figure 5C:
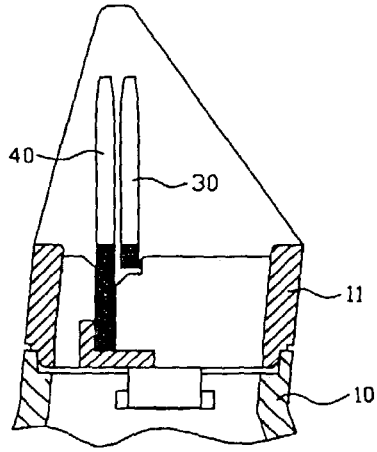
Figure 6:
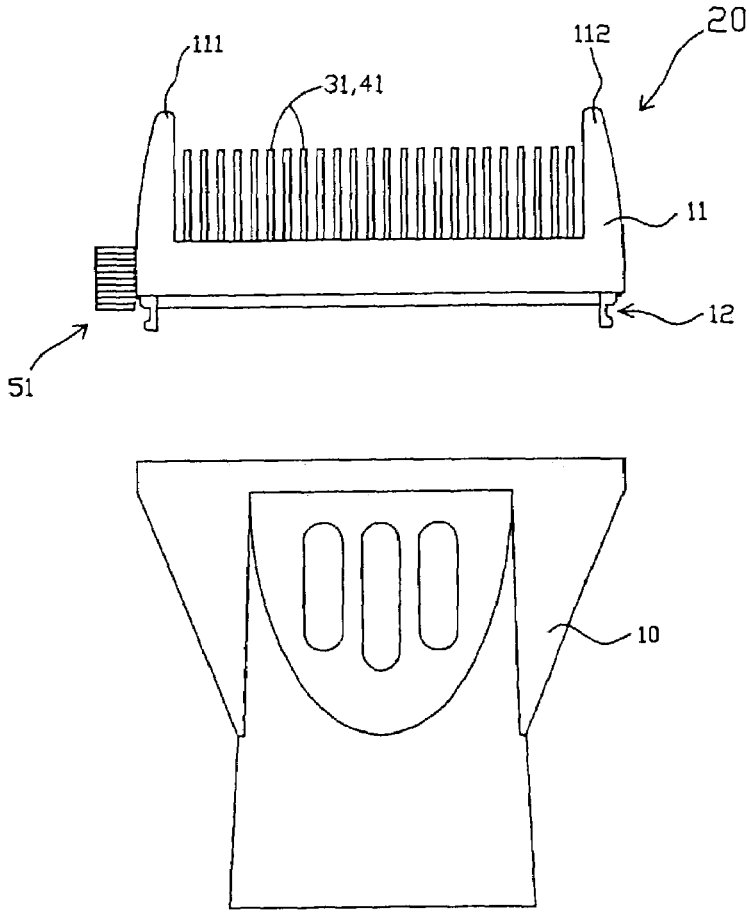
FIG. 6 is a top plan view showing the comb sub-assembly detached from the rest of the attachment.
Figure 6A:
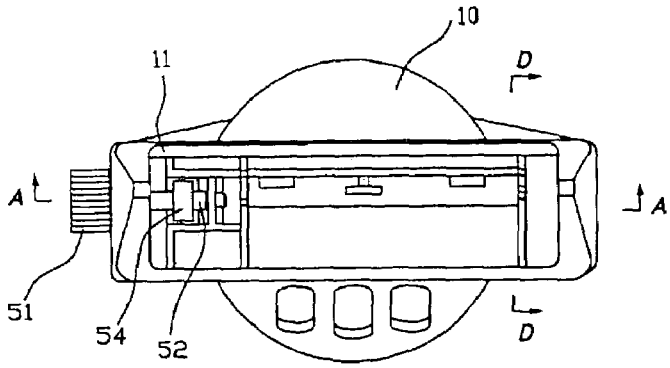
FIG. 6A is the front view of FIG. 1 with the comb members removed.

Referring more specifically to FIGS. 4 to 5C, the second comb member 40 is fixedly connected to the main housing 10 and more specifically, to the head portion 11 of the main housing 10 with the teeth generally extending along the second direction from the base portion 42. The head portion 11 of the main housing is also substantially rigid and includes a top, a bottom, sideguards and a front aperture exposing the comb teeth. The sideguards 111, 112 together form a bracket enclosing the teeth members and extend beyond the tip of the comb teeth to keep away hair outside the region being combed from entering the teethed regions. The first, movable, comb member 30 is supported by the second comb member 40 in a movable manner by supporting arrangements 13 which are shown in more detail in FIG. 5A.

The supporting arrangement 13 includes a rivet 131 which connects the first and the second comb members by its stem and traps the comb members by its heads. In order that the first comb member 30 can be movable along the second direction, an elliptical aperture with an opening slightly larger than the diameter of the rivet stem is formed on the first comb member 30. The elliptical aperture is sized so that the first comb member 30 can be translatable along the first direction while being retained by the rivet head.

A separator which is a washer 132 in the present example is placed between the comb members to reduce contact area and therefore fiction. To adjust the range of movement and to avoid the rivet from clamping directly on the first comb member, a metal liner 133 is introduced to surround the portion of this stem above the plane of the second comb member 40. This metal liner 133 trims the space between the rivet stem and the aperture on the first comb member for an appropriate range of translation along the first direction, as well as elevating the head of the rivet above the base portion of the first comb member 30.

In order to move and also to control the gradual movement of the first comb member 30, the first comb member 30 is connected to a teeth spacing adjustment means 50 which includes a movement mechanism. The movement mechanism includes a rotary member having a circular head 51 and a screw-threaded shaft portion 52. The shaft portion 52 is rotatably supported on the left sideguard 111 of the main housing.

To restrict the longitudinal movement of the rotary member relative to the sideguard 111, a retention member which is a clip 53, preferably engaging on a circular groove on the shaft 52, is disposed adjacent to the sideguard of the head portion 11. A nut 54 which is engaged on the threaded portion of a shaft 52 is engaged with an indentation formed on the base portion 32 of the first comb member 30. The engagement between the indentation and the nut 54 is preferably in a close-fitted manner so that any longitudinal translation of the nut 54 along the first direction as a result of the rotation of the circular head 51 of the rotary member will result in transactional movement of the first comb member along the first direction.

In order to restrict further, unwanted, movements of the movable comb member 30 once a preferred teeth spacing has been selected and set, corresponding holding means are formed on the underside of the rotary adjustment knob 51 and the outside of the sideguard 111. This holding means 510 includes a small dome-shaped indentation 511 formed on the underside of the rotary adjustment knob 51 for engagement with a correspondingly shaped and positioned stud 512 on the outside of the sideguard 111. The holding means 510 can be released from engagement by pulling the rotary adjustment knob 51 away from the sideguard 111 or by depressing the sideguard 111 carrying the rotary member towards the other sideguard 112. The residual resilience of the substantially rigid head portion will then allow this disengagement of the holding means.

In order to allow the first comb member to be retained in a plurality of pre-determined positions corresponding to pre-determined effective teeth spacings, a plurality of holding indentations 511 are distributed on the underside of the rotary knob 51 for engagement with the stud 512.

Turning now to the operation of the teeth spacing adjustment means, when the rotary head is rotated, the threaded portion of the shaft 52 will also rotate, thereby causing the nut 54 to move towards or away from the rotary head 51 along the threaded shaft. Because of the engagement of the nut 54 with the indentation on the base portion 32 of the first comb member, the first comb member 30 will be brought to move along the longitudinal direction of the shaft 52. Therefore, by disposing the shaft 52 along the first direction, the first comb member can be moved along the first direction with the elongated teeth on the first comb member moving generally parallelly to the elongated teeth on the second comb member.

As the present comb attachment is designed for operation when coupled with a hair-dryer or hair blower, one end 13 of the main housing is generally tubular and shaped corresponding to the barrel exit of a compatible hair-dryer or hair blower. In order to divert excessive warm or hot air to move away from the hair if the air outlet of the attachment is blocked while combing, downstream air diverting outlets 14 are disposed adjacent to the head portion of the main housing so that the warm or hot air can be diverted to avoid overheating the scalp.

During normal use, hot or warm hair emanating from a hot or warm air blower will warm or heat up the teeth 31, 41 on the comb attachment. When the teeth spacing has been appropriately adjusted, the hair will be under tension if the attachment is pulled against the hair. This tension together with the heat will cause straightening or styling of hair as and when desired. It will be noted that metallic teeth will be more efficient for heat transfer for the present purposes.

Referring to FIGS. 8 to 11, there is shown a second preferred embodiment of a comb attachment of the present invention. Similar to the first preferred embodiment, this comb attachment 2 also includes a main housing 10 and a comb sub-assembly 2. The comb sub-assembly 2 includes a first comb member 30, a second comb member 40 and teeth width adjustment means 60. Each of the first comb member 30 and the second comb member 40 includes a plurality of elongated teeth 31, 41 extending from a base portion 32, 42. In general, the two embodiments are identical except for the teeth width adjustment means 60. Similar to the first preferred embodiment, the movable first comb member is riveted to the fixed, second, comb member 40 with an elliptical aperture formed on the first comb member 30 with the same peripheral parts.

Instead of a rotary means for adjusting the effective teeth spacing, teeth width spacing adjustment means 60 in the present embodiment includes a push-tab arrangement more particularly shown in FIGS. 9, 9B, 9C and 10. The push-tab arrangement includes a push-tab member 61 disposed on the top surface of the head portion 11 and an engagement member with an engagement protrusion 66 disposed underneath the top surface for selection of pitch width by a user. The engagement member includes a pair of bifurcated legs extending through the head portion 11. An elongated hook with a protrusion 66 extending towards the underside of the head portion 11 is formed at the end of each of the bifurcated legs. The underside of the push-tab member is connected to a fork member 62 for driving engagement with a pivotal cock member 63 which is in turn connected to the first comb member 30. The cock member 63 is pivotally mounted about an axis 64 on the head portion of the main housing 10 and includes a first end in driving engagement with the first comb member 30 and a second end in driving engagement with the fork member 62 of the push-tab 61. Holding means are correspondingly formed on the top portion of the main housing and the underside of the push-tab 61. In the present embodiment, the holding means include a plurality of indentations 65 and the engagement members. The indentations 65 are formed on the main housing and arranged corresponding to discrete effective teeth spacing. The engagement means includes at least a protrusion 66 for engaging with the selected indentation in order to lock the first comb member 30 at a pre-determined position corresponding to a pre-determined effective teeth spacing. Thus, a user can select one of the discrete effective teeth spacings by selecting the positions "1", "2", "3" and "4" to conveniently select the effective teeth spacing for hair caring. The selected position will be reasonably fixed by the engagement between the protrusion 66 with the corresponding indentation 65. This engagement can be released by pushing the push-tab member 61 away from the selected position along the second direction and the resilience of the push-tab arrangement.

Turning now to the operation of the teeth spacing adjustment means, when the push-tab is moved along the second direction, the fork member 62 disposed underneath the push-tab 61 will drive the second end of the cock which causes a pivotal movement of the first end of the cock about the pivotal axis 64, thereby moving the first comb member 30 along the second direction to adjust the effective teeth spacing.

Figure 14:
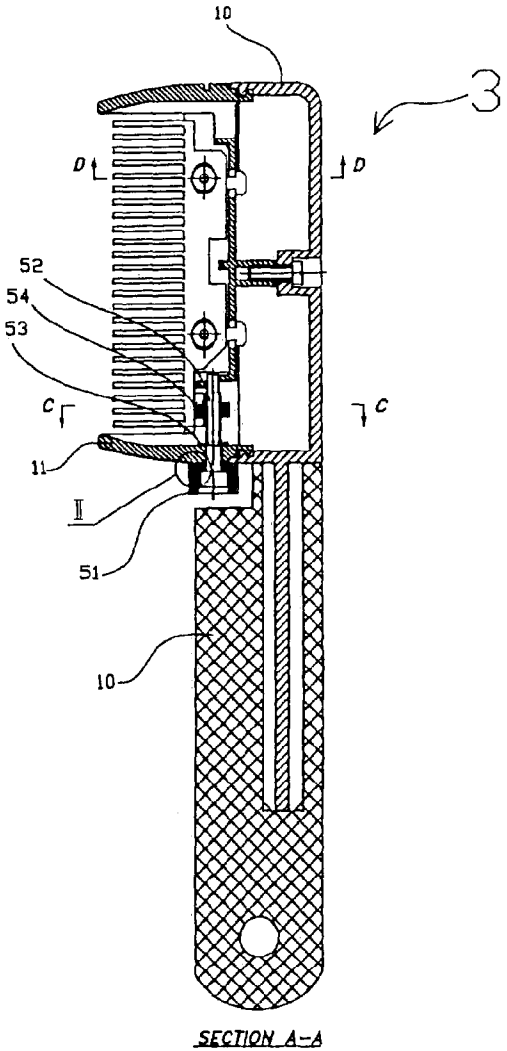
FIG. 14 is a cross-sectional view of the hair comb of FIG. 13 taken along the line A-A of FIG. 12.
Figure 13:
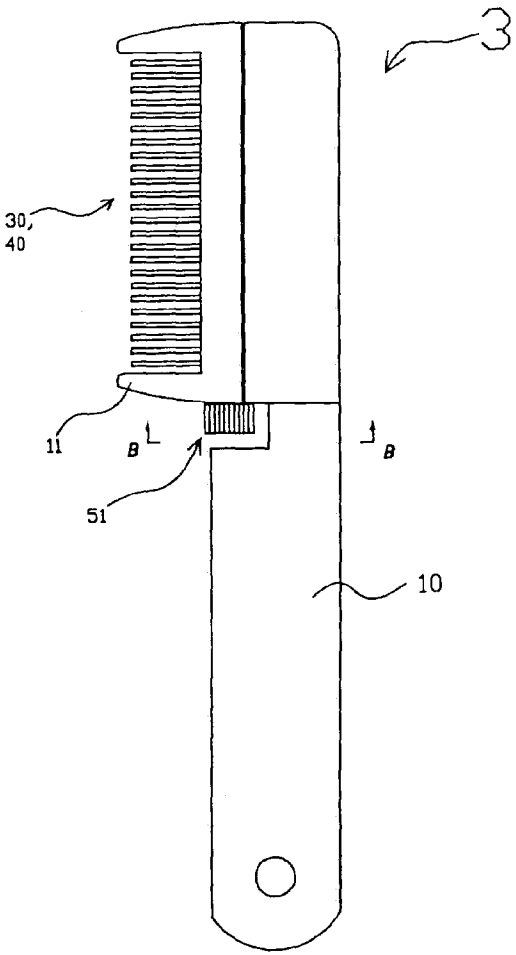
FIG. 13 is a top view of the hair comb of FIG. 12 with the comb members intact.
Figure 12:
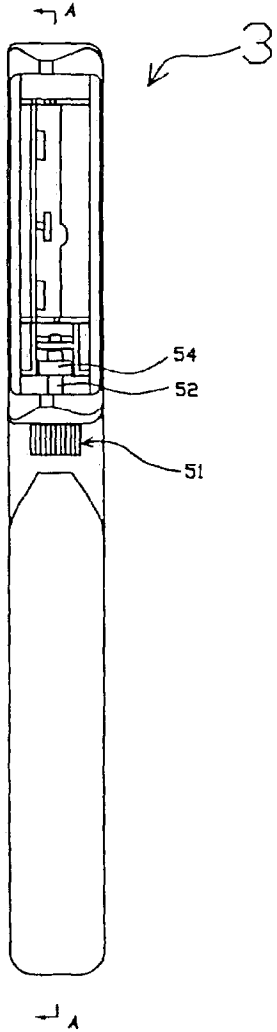
FIG. 12 is a front view of a hair comb of a third embodiment of the present invention with the comb members removed.

Referring to FIGS. 12 to 14, there is shown a third preferred embodiment of the present invention of a hair care device which is configured as a comb 3. The comb 3 includes combing means, means for adjusting effective teeth spacing, a main housing 10 and a comb sub-assembly 20. The comb sub-assembly includes a first comb member 30, a second comb member 40 and teeth width adjustment means 50. Each of the first comb member 30 and the second comb member 40 includes a plurality of elongated teeth 31, 41 extending from a base portion 32, 42. In this preferred embodiment, the relative disposition of the comb members and the teeth spacing adjustment means 50 are generally identical to that of the first embodiment with appropriate corresponding modifications which are obvious to persons skilled in the art.

Figure 17:
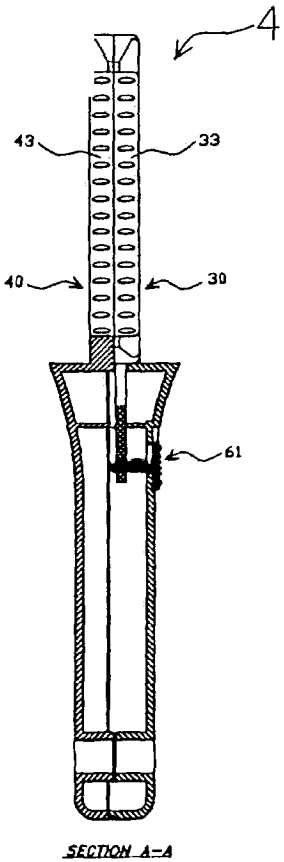
FIG. 17 is a cross-sectional view of the hair comb of FIG. 15 exposing the more important features of the teeth adjustment means.
Figure 16:
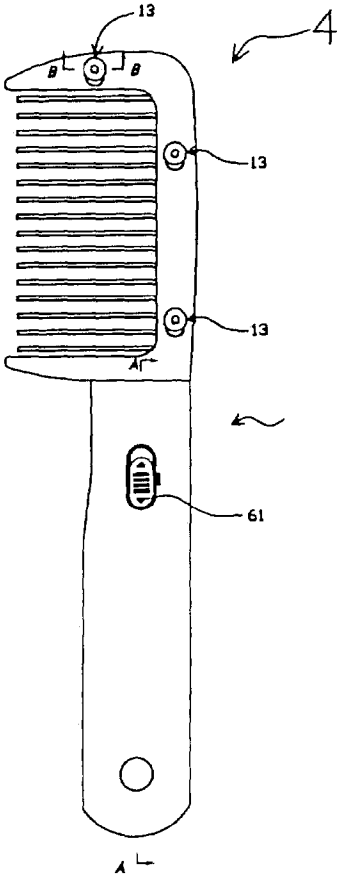
FIG. 16 is a top view of the hair comb of FIG. 15.
Figure 15:
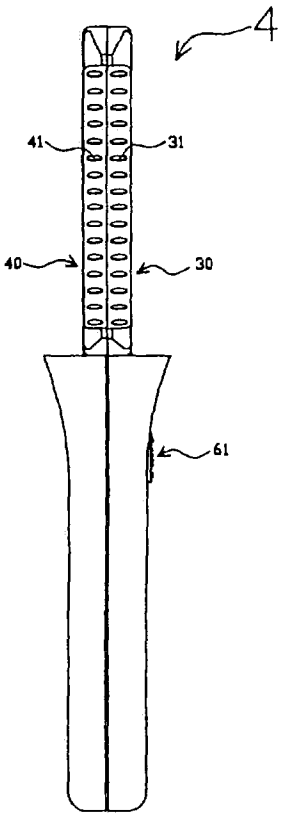
FIG. 15 is the side view of a fourth embodiment of the present invention configured as a hair comb.

Referring to FIGS. 15 to 17, there is shown a fourth preferred embodiment of the present invention configured as a comb 4 similar to that of the third embodiment but employing the teeth spacing adjustment means 60 of the second preferred embodiment.

Figure 17A:
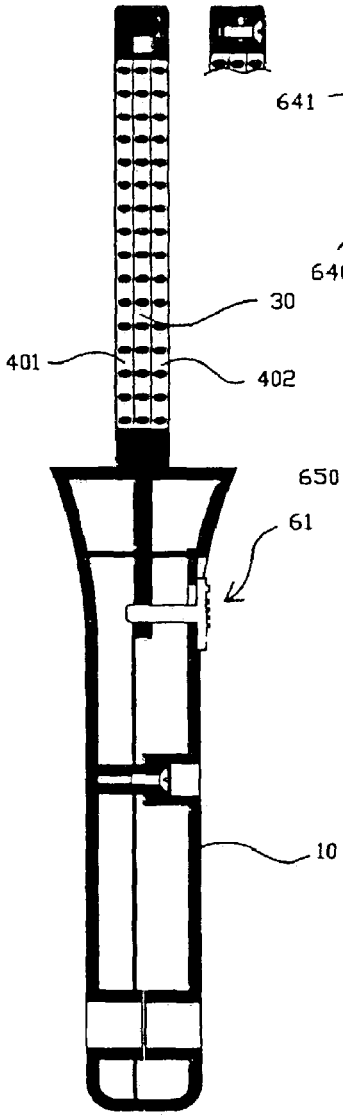
FIG. 17A is a cross-sectional view of a modified version of the hair comb of FIG. 15 exposing the fixed and movable comb members as well as the teeth adjusting means.

Referring to FIG. 17A, there is shown a modified form of the comb of FIGS. 15 to 17. This comb includes a movable first combing means and a fixed second combing means which are relatively movable so that the effective teeth spacing of the comb, that is, the teeth spacing traversing the comb, can be adjusted. This specific embodiment is generally identical to the embodiment of FIGS. 15 to 17 except that the movable comb member 30 of the first combing means is disposed between a left fixed comb member 401 and a right fixed comb member 402 of the first second combing means. The disposition of a movable comb member 30 between the two fixed comb members 401, 402 of the second combing means alleviates or relieves the stress on the movable comb member 30 since the stress is negotiated and shared by the fixed comb members first. It will be noted that the width of the teeth, which is the dimension of the teeth along the longitudinal direction of the comb members, is comparable to the spacing between adjacent teeth on a comb member so that the effective teeth spacing for varying the tension to apply on hair can be gradually adjusted between a maxima and a minima.

Figure 18:
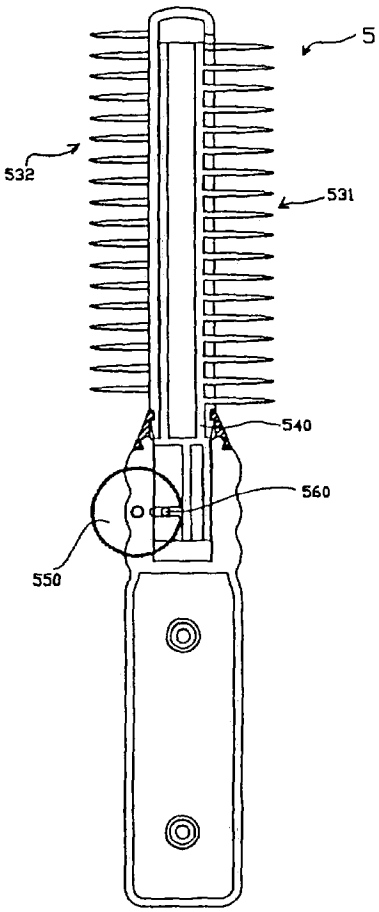
FIG. 18 is a cross-sectional view of a hairbrush showing a fifth preferred embodiment of the present invention.

Referring to FIG. 18, there is shown a fifth preferred embodiment of the present invention configured as a hairbrush 5. This hairbrush 5 includes a first (movable) combing means, a second (fixed) moving means, a handle and means for adjusting effective teeth spacing. In this preferred embodiment, the hairbrush includes a plurality of radially extending bristles which are organized into first combing means comprising a first group of movable bristles 531 and combing means comprising a second group of fixed bristles 532. The movable bristles are connected to a shaft or base portion 540 which is movable along the longitudinal direction corresponding to the first direction in the earlier embodiments. The group of movable bristles 531 are translatable along the longitudinal axis (the "first direction") of the hairbrush by connection to the teeth width adjustment means similar to those described in the earlier preferred embodiments. In this specific embodiment, a rotary wheel 550 with a radial slot for engaging with a stud 560 connected to the shaft 540 is provided to move the second bristle group along the axial, or first direction are illustrated as an example.

Figure 19:
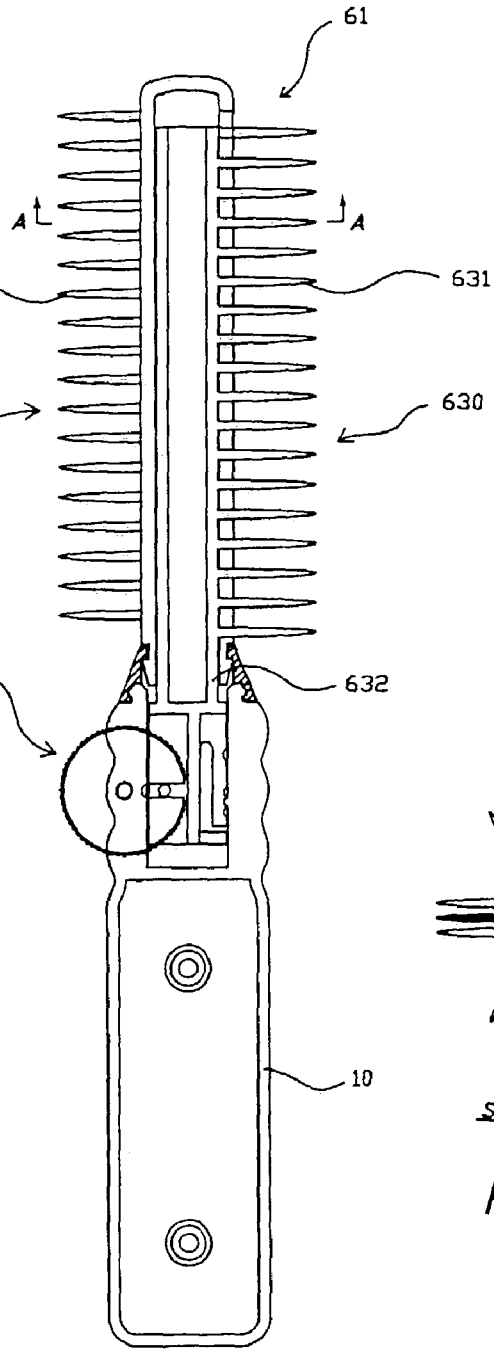
FIG. 19 is a cross-sectional view of a hair brush showing a sixth preferred embodiment of the present invention.
Figure 19A:
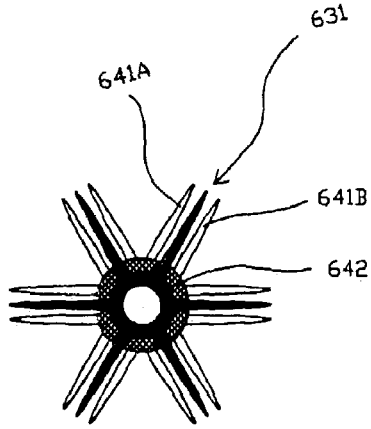
FIG. 19A is a cross-sectional view taken along the line A-A of FIG. 19.

Referring to FIGS. 19 and 19A, there is shown a sixth preferred embodiment of the present invention also configured as a hairbrush 6 which includes a movable comb member 630 with teeth members 631 extending radially from the base portion 632 of the comb members. The hairbrush 6 also includes a fixed comb member 640 which are fixed to the housing 10 of the hairbrush and with teeth members 641 extending from the base portion 642 of the fixed comb member. In contrast to the hairbrush of FIG. 18, the teeth members 631 of the movable comb member 630 of this specific embodiment are disposed intermediate between a first 641A and a second 641B rows of teeth members extending radially from the base portion 642 of the fixed comb member. Similar to the embodiment of FIG. 17A, this sandwiching of the movable comb member between two rows of fixed teeth members alleviates or relieves the stress from the movable teeth members for more effective and more durable brushing.

A yet further embodiment of the invention is shown in FIGS. 20A-20F. This embodiment is a hair care device in the form of a comb having a first (movable) combing means, a second (fixed) moving means, a handle and means for adjusting effective teeth spacing. The combing means 702 comprises first combing means and second combing means which are attached to the handle 701. The first combing means includes second combing row 705. The second combing means includes first 703 and third 707 combing rows.

Figures 20A, 20B, 20C, 20D, 20E, 20F:
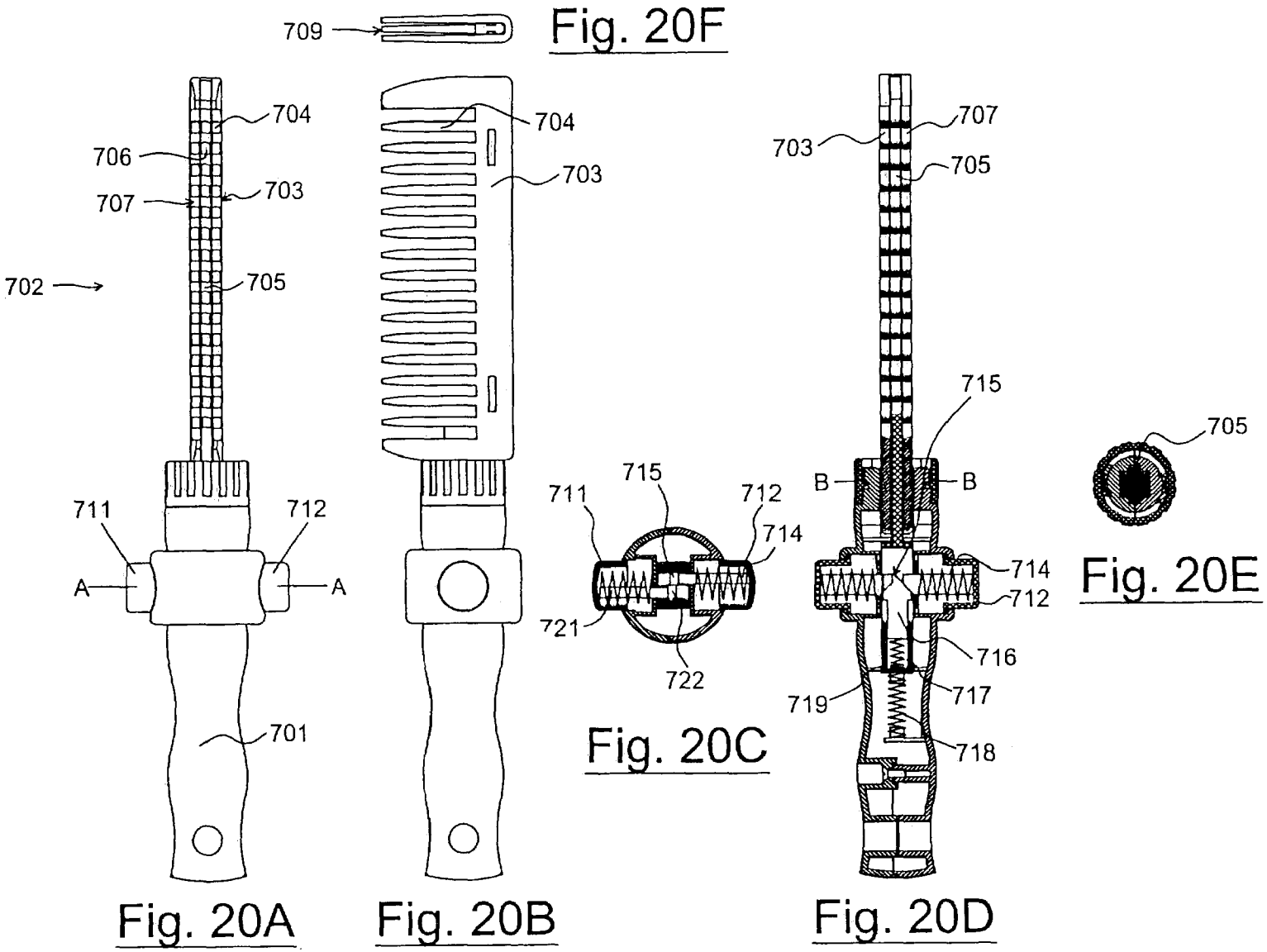
FIG. 20A is a front elevation of a hair care apparatus in accordance with a yet further embodiment of the invention.
FIG. 20B is a side elevation of the apparatus of FIG. 20A.
FIG. 20C is a cross-sectional end elevation through the axis A-A on FIG. 20A.
FIG. 20D is a cross-sectional front elevation of the apparatus of FIG. 20A.
FIG. 20E is a cross-sectional end elevation on axis B-B from FIG. 20D.
FIG. 20F is an end elevation of the apparatus of FIG. 20B.

As seen in FIG. 20A, the comb portion comprise at least a first comb row 703 having teeth 704 connected to the handle 701 and a second comb row 705 having teeth 706. In this particular form, a third comb row 707 is also connected to the handle 701.

The second comb row 705 is mounted on a substantially parallel axis to the first and third combs 703 and 707 and is moveable relative to both the first and third comb rows 703, 707 along that parallel axis. In this manner, the second comb 705 can be moved to reduce the effective spacing 708 between the teeth in a direction transverse to the axes on which the combs are mounted.

Similar to the other embodiments above, the combing means 702 can be formed of metal, plastics or other suitable materials. When hair is engaged by the combing means 702, pulled under tension and heated, hair straightening or styling can be done. To enhance the straightening or styling efficiency, some or all of the combing teeth or the comb rows are made of thermally conductive materials such as metal or with metal plating. With such a thermally conductive combing means, heat can be absorbed by the combing means and can be transferred more efficiently to the engaged hair, thereby enhancing styling efficiency. In the present embodiment, the second (fixed) combing means is made of metal so that can be absorbed by the base portion can then be transferred to the hair via the combing teeth. As the fixed combing means are firmly attached to the handle, they are more robust than the movable comb and can therefore resist or withstand higher combing tension. Thus, it is preferred that the teeth on the fixed comb rows are thermally conductive and made, for example, of metal or other thermally conductive materials. Also, heating means can be included to provide heating to the combing means.

The arrangement of the combs may be seen in FIG. 20F whereby the central second comb 705 is moveable in a gap 709 between the first and third combs 703 and 707.

Movement of the second comb 705 is actuated by a user actuating a button 711 or 712. Two buttons are provided in this embodiment and actuation of either will result in movement of the second comb 705. The use of two buttons on opposed sides of the handle is to accommodate the actuation when the comb is held in either the left or right hands of a user.

The actuating mechanism can be seen in more detail in FIG. 20D. The button 712 is connected to a shaft 714 acting upon a cam 715. The shaft and cam have cooperating surfaces such that depression of the button 712 and hence the shaft 714 will cause retraction of the member 76 carrying the cam surface 715.

It will be noted that the member 716 is not directly linked to the comb 705. Although a direct connection would cause the necessary movement of the comb 705, this embodiment does not seek to move and lock the comb 705 by a discrete interval. Instead, actuation of the button 712 will cause continuous movement of the comb 705 and a user can dictate the resultant gap between the teeth of the combs by control of the depth of depression of the button 712. The risk of direct connection is that a user may press to hard on the button 712 and catch hair in between the teeth causing pain or damaging the hair so caught. Of course, the direction of movement of the movable comb 705 can be changed by changing the cam surface relationship between the shaft 714 and the cam 715 without loss of generality.

To limit this effect, a pressure limiting mechanism is employed to limit the pressure applied by the teeth against the hair pressing in between.

The pressure limiting mechanism may take a variety of forms and in this embodiment is incorporating as a biasing means within the actuating mechanism.

Referring again to FIG. 20D, it can be seen that movement of the member 716 away from the comb end of the device is transmitted through a second biasing means in the form of a compression spring 717 to a portion 719 that is in direct connection with the comb 705. In turn, the portion 719 in the form of a U shaped member is acting against the urging of a first biasing means 718 that seeks to return the comb 705 to the open position. In the embodiment, the first biasing means 718 is of lower compressive strength than the second biasing means 717. Hence, upon movement of the button 712, the member 716 and 717 will move substantially at the same time against the urging of the biasing means 718. However, should the user depress the button 712 to the extent that it may place too much pressure on hair between the teeth of the comb, further movement of the comb 705 is controlled by the threshold value of the compressing spring 717.

Referring to FIG. 20C, it can be seen that each button 711 and 712 actuates a separate shaft 714, 721 that act upon their own cam surfaces 715, 722. These cam surfaces are angled in an opposed relationship on the end of the member 716 so as to act in the correct direction regardless of whether button 712 or 711 is depressed.

A yet further embodiment of the invention is shown in FIGS. 21A-E. In this embodiment, the hair care device comprises a comb attached to a handle also employing heated air to the hair being drawn between the teeth of the comb. Otherwise, the mechanism is similar with three sets of bristles or teeth 801, 802 and 803, extending from a handle portion 804. As with the previous embodiment, the middle row of teeth 802 are movable with respect to the two outer rows.

Figures 21A, 21B, 21C, 21D, 21E:
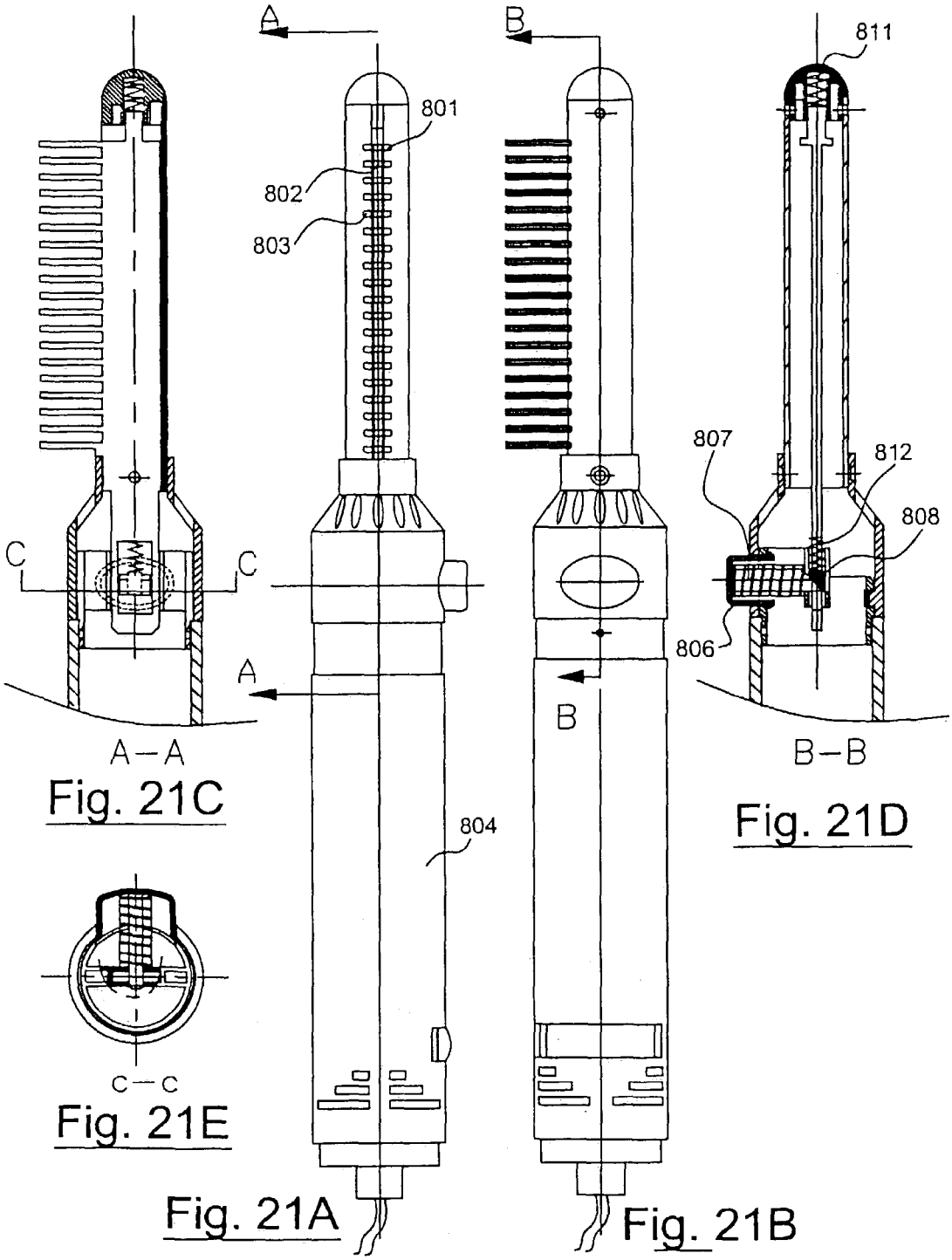
FIG. 21A is a front elevation of a yet further embodiment of the apparatus.
FIG. 21B is a side elevation of the apparatus of FIG. 21A.
FIG. 21C is a partial cross-sectional elevation on axis A-A from FIG. 21A.
FIG. 21D is a partial cross-section on axis B-B on FIG. 21B.
FIG. 21E is a cross-sectional end elevation on axis C-C from FIG. 21C.

Referring to FIG. 21D, it can be seen that the actuating mechanism comprises a button 806 that in turn depresses a shaft 807 acting against an angled cam surface 808. In this instance depression of the button moves the cam surface towards the comb of the device to urge the movable comb 802 away from the handle.

Transmission of the force on the comb 802 is against a first biasing means 811 seeking to return the comb to the widest teeth spacing. However, this transmission of force is through a second biasing means 812 that can again limit the pressure applied laterally to hair drawn through the comb. In effect, the comb 805 is balanced between the two compression springs 811 and 812. Provided the compressive strength of the first biasing means 811 is less than that of the second biasing means 812, movement of the cam surface 808 will seek to move the comb 802 such that the teeth reduce the spacing between the teeth of the comb 805 and the adjacent combs 801 and 803. Should the pressure applied to the hair be greater than the threshold value of the second biasing means 812, further movement of the button and the cam surface 808 will only cause compression of the spring 812 and not result in further movement of the comb 802.

A still yet further embodiment of the invention is shown in FIGS. 22A-D in which the invention is provided in the form of a comb similar to that as shown in FIG. 20A. The difference with this embodiment is in the actuating mechanism.

Actuation is obtained by sliding the button 902 with respect to the handle 901. As shown particularly in FIG. 22A, the movable comb 904 is movable between the outer combs 903, 905 to reduce the teeth spacing. Retraction of the sliding button 902 away from the combs causes similar movement of the member 907. The comb 904 is connected directly to the distal portion 908 help between two biasing means 911 and 912.

Initial movement of the slide 902 is transmitted through the member 907 and the second biasing means 912 so as to cause movement of the portion 908 and the comb 904 against the action of the biasing means 911. As with the previous embodiments, the compressive strength of the first biasing means 911 is less than that of the second biasing means 912. However, should the pressure created between the teeth by hair passing through the teeth exceed the threshold value of the second biasing means 912, further movement of the slide 902 causes compression of the spring 912 instead of further movement of the comb 904.

In the above description, the same numerals have been used to refer to parts which are common to the various embodiments without loss of generality.

While the present invention has been explained by reference to the preferred embodiments, described above, it will be appreciated that the embodiments are only examples provided to illustrate the present invention and are not meant to be restrictive on the scope and spirit of the present invention. This invention should be determined from the general principles and spirit of the invention as described above. In particular, variations or modifications which are obvious or trivial to persons skilled in the art, as well as improvements made on the basis of the present invention, should be considered as falling within the scope and boundary of the present invention. Furthermore, while the present invention has been explained by reference to comb attachments, combs and hairbrushes, it should be appreciated that the invention can apply, whether with or without modification, to other hair care devices, attachments or apparatus.

The invention claimed is:

1. A hair care device including hair combing means having a plurality of combing teeth arranged into a plurality of parallel comb rows comprising a first comb row and a second comb row each having a plurality of comb teeth, said first and second comb rows being relatively movable, a movement mechanism for relatively moving said comb rows whereby the effective teeth spacing transversely across comb rows is adjustable, said movement mechanism including a driving member for causing a change in hair engaging tension by varying the effective teeth spacing across comb rows, and a holding mechanism; wherein at least some of said movable combing teeth are thermally conductive so that heat can be conducted from said comb rows to a user's hair being styled during use when hair is being engaged under tension by said comb rows, and wherein said holding mechanism comprises an arrangement of a plurality of indentations and a stud for engaging with one of said plurality of indentations, and cooperative engagement between said stud and one of said indentations defines a user selectable position corresponding to one of a plurality of discrete positions during use, and each one of said discrete positions corresponds to a pre-determined effective teeth spacing, and wherein said driving member comprises a push-tab member and at least some of the comb teeth on said comb rows are adapted so that the effective teeth spacing of said comb rows is adjustable by relative movements between said comb rows, wherein movement of said push-tab member brings about movement of said plurality of movable teeth whereby the effective teeth spacing of said comb rows is changed.

2. A hair care device according to claim 1, wherein the width of said some of said comb teeth is comparable to their teeth spacing, and wherein said movement mechanism comprises a means for maintaining said movable combing teeth at predetermined positions, and said pre-determined positions correspond to discrete settings of different effective teeth spacing of said device.

3. A hair care device according to claim 1, wherein the width of said some of said comb teeth is comparable to the teeth spacing between correspondingly adjacent comb teeth, said movement mechanism comprises means for maintaining said movable combing teeth at predetermined positions, and said pre-determined positions correspond to discrete settings of effective teeth spacing of said device.

4. A hair care device according to claim 1 and including heating means, wherein said heating means are disposed so that heat generated by said heating means can be transferred from said heating means to the hair via said combing means.

5. A hair care device according to claim 1, wherein said combing means includes a first comb row and a second comb row which are relatively movable, and said device is a hair styling attachment with a housing comprising an attachment mechanism for coupling to the nozzle of a hair blower.

6. A hair care device according to claim 5 and including a main housing, wherein said first comb row is movable relative to said main housing, and further including a third comb row, said first, second and third comb rows being generally parallel and said first comb row being intermediate of said second and third comb rows, wherein the effective combing teeth spacing of said combing means transverse to said comb rows is adjustable by relative movements of said first, second and third comb rows.

7. A hair care device according to claim 6, wherein said second and third comb rows are generally thermally conductive.

8. A hair care device according to claim 6, wherein said second comb row includes metallic combing teeth extending from a metallic base.

9. A hair care device according to claim 6, wherein each of said first, second and third comb rows includes a plurality of generally parallel combing teeth, wherein the teeth of said comb rows are adapted so that the effective teeth spacing across said combing means is adjustable by relative movements of said comb rows.

10. A hair care device according to claim 6 and including a handle, said first and second comb rows being respectively movable and stationary relative to said handle, the width of the teeth on said first comb row being comparable to the teeth spacing between corresponding adjacent teeth or teeth pairs on said second comb row so that the effective spacing across said comb rows is adjustable by movement of said first comb row.

11. A hair care device according to claim 10, wherein at least some of the teeth on said second comb row are thermally conductive so that when hair is engaged by said combing means, heat can be transmitted to said hair via said thermally conductive teeth.

12. A hair care device according to claim 5, wherein said first and second comb rows are relatively translatable along a first direction, said combing teeth being generally elongated and extending along a second direction, wherein relative translation between said first and second comb rows along said first direction will cause said elongated teeth on one comb row to traverse the spacing between adjacent teeth pairs on the other comb row to vary the effective teeth spacing of said device, said movement mechanism controls the relative translation between said first and second comb rows.

13. A hair care device according to claim 12, wherein said movement mechanism is adapted for gradually translating one of said comb rows.

14. A hair care device according to claim 13, wherein said holding mechanism includes means to maintain said one of said comb rows at pre-determined positions along said first direction.

15. A hair care device according to claim 14, wherein said pre-determined positions correspond to discrete settings of the effective teeth spacing of said device.

16. A hair care device according to claim 5, wherein said first and said second directions are substantially orthogonal.

17. A hair care device according to claim 5, wherein the teeth spacings on said first and second comb rows are generally equal.

18. A hair care device according claim 8, wherein said housing includes a hollow member with an air-inlet, an air-outlet, and a neck portion interconnecting said air-inlet and said air-outlet, said comb members being disposed at said air-outlet with said teeth pointing away from said air-outlet.

19. A hair care device according to claim 18, wherein said housing includes means for coupling to the nozzle of a hair care apparatus with a blower.

20. A hair care apparatus including an air blower and a hair care device having hair combing means with a plurality of movable combing teeth arranged on a plurality of comb rows comprising a first comb row and a second comb row each having a plurality of comb teeth, said first and second comb rows being relatively moveable so that the effective teeth spacing transversely across said comb rows is variable, a movement mechanism for adjusting effective teeth spacing between adjacent combing teeth, and a holding mechanism, wherein at least some of said combing teeth are thermally conductive so that heat can be conducted from said comb rows to a user's hair via said thermally conductive combing teeth when said hair is being engaged under tension by said combing teeth, wherein said holding mechanism comprises an arrangement of a plurality of indentations and a stud for engaging with one of said plurality of indentations, and cooperative engagement between said stud and one of said indentations defines a user selectable position corresponding to one of a plurality of discrete positions during use, and each one of said discrete positions corresponds to a pre-determined effective teeth spacing, wherein said movement mechanism comprises a driving member which is arranged to cause change in hair engaging tension by varying the effective teeth spacing between said adjacent combing teeth, and wherein said driving member comprises a push-tab member and at least some of the comb teeth on said comb rows are adapted so that the effective teeth spacing of said combing rows is adjustable by relative movements between said comb rows, wherein movement of said push-tab member brings about movement of said plurality of movable teeth whereby the effective teeth spacing of said comb rows is changed.

21. A hair care device including hair combing means with a plurality of combing teeth arranged on a plurality of comb rows comprising a first comb row and a second comb row each having a plurality of comb teeth, said first and second comb rows being relatively moveable so that the effective teeth spacing transversely across said comb rows is variable, a movement mechanism for adjusting effective teeth spacing between adjacent combing teeth, and a holding mechanism, wherein said hair comb rows includes a plurality of movable combing teeth, and at least some of said movable combing teeth are thermally conductive so that heat can be conducted from said comb rows to a user's hair being styled during use when hair is being engaged under tension by said comb rows, and wherein said holding mechanism comprises an arrangement of a plurality of indentations and a stud for engaging with one of said plurality of indentations, and cooperative engagement between said stud and one of said indentations defines a user selectable position corresponding to one of at least three discrete positions during use, and each one of said discrete positions corresponds to a pre-determined effective teeth spacing, wherein said movement mechanism comprises a driving member which is arranged to cause change in hair engaging tension by varying the effective teeth spacing between said adjacent combing teeth, and wherein said driving member comprises a push-tab member and at least some of the comb teeth on said comb rows are adapted so that the effective teeth spacing of said combing rows is adjustable by relative movements between said comb rows, wherein movement of said push-tab member brings about movement of said plurality of movable teeth whereby the effective teeth spacing of said comb rows is changed.

* * * * *